US007447476B2

(12) United States Patent
Murase et al.

(10) Patent No.: US 7,447,476 B2
(45) Date of Patent: Nov. 4, 2008

(54) CLEANING UNIT AND IMAGE FORMING DEVICE

(75) Inventors: Koji Murase, Osaka (JP); Tomoyuki Oda, Osaka (JP); Hidenori Takenaka, Osaka (JP); Jumpei Hobo, Osaka (JP); Hiroyuki Ueda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 79 days.

(21) Appl. No.: 11/535,473

(22) Filed: Sep. 26, 2006

(65) Prior Publication Data

US 2007/0071526 A1 Mar. 29, 2007

(30) Foreign Application Priority Data

Sep. 27, 2005 (JP) ..... 2005-280196

(51) Int. Cl.
*G03G 21/00* (2006.01)

(52) U.S. Cl. ..... 399/348

(58) Field of Classification Search ..... 399/249, 399/348

See application file for complete search history.

(56) References Cited

U.S. PATENT DOCUMENTS 5,285,244 A * 2/1994 Bujese ..... 399/249
5,841,456 A * 11/1998 Takei et al. ..... 399/249
6,898,404 B2 * 5/2005 Sakai et al. ..... 399/249
2002/0110390 A1 * 8/2002 Park et al. ..... 399/237

FOREIGN PATENT DOCUMENTS

JP 2001-296780 A 10/2001
JP 2001324902 A * 11/2001

* cited by examiner

*Primary Examiner*—Ryan Gleitz
(74) *Attorney, Agent, or Firm*—Global IP Counselors, LLP

(57) ABSTRACT

A cleaning unit includes a traveling belt and a belt cleaning member. The traveling belt is formed in a loop and travels via the vicinity of the contact point between an image support member and an image support member cleaning member, and comes into contact with liquid developer stored in the cleaning unit. The belt cleaning member is in contact with the traveling belt and arranged in a position downstream of the contact point between the traveling belt and liquid developer stored in the cleaning unit, and upstream of the point at which the traveling belt passes the vicinity of the contact point between the image support member and the image support member cleaning member in the traveling direction of the traveling belt. The belt cleaning member is configured to remove liquid developer attached to the traveling belt.

9 Claims, 3 Drawing Sheets

CLEANING UNIT AND IMAGE FORMING DEVICE

CROSS-REFERENCE TO RELATED APPLICATIONS

This application claims priority to Japanese Patent Application No. 2005-280196. The entire disclosure of Japanese Patent Application No. 2005-280196 is hereby incorporated herein by reference.

BACKGROUND OF THE INVENTION

1. Field of the Invention

The present invention relates to a cleaning unit comprising an image support member cleaning member, such as a blade, that will come into contact with an image support member on which an image is formed with liquid developer, and remove liquid developer attached to the image support member, and an image forming device comprising the same. In particular, the present invention relates to a technology for removing liquid developer attached to the image support member cleaning member.

2. Background Information

A member such as a cleaning blade that contacts with an image support member such as a photosensitive drum and removes liquid developer attached to the image support member is provided in a so-called wet image forming device typified by a copying machine and a printer that perform image formation with liquid developer.

In addition, liquid developer attached to the cleaning blade and the like is removed by another member. For example, Japan Patent Application Publication JP-A-2001-296780 discloses a technology for removing liquid developer attached to a cleaning blade that is used for removing liquid developer from an image support member (i.e., photosensitive drum) by a sponge roller, a brush roller, and the like.

However, if liquid developer removed from the cleaning blade accumulates on a sponge roller or a brush roller used to clean the cleaning blade, the cleaning efficiency of the sponge roller and the brush roller will decrease. Therefore, the cleaning blade will not be sufficiently cleaned. Accordingly, the cleaning efficiency of the image support member via the cleaning blade will decrease, and this will result in an adverse effect on, for example, the quality of the images produced.

In view of the above, it will be apparent to those skilled in the art from this disclosure that there exists a need for an improved cleaning unit that can sufficiently remove liquid developer attached to an image support member cleaning member that is configured to clean an image support member such as a photosensitive drum, and an image forming device comprising the same. This invention addresses this need in the art as well as other needs, which will become apparent to those skilled in the art from this disclosure.

SUMMARY OF THE INVENTION

In order to achieve the above described object, the present invention provides a cleaning unit comprising an image support member cleaning member, a traveling belt, and a belt cleaning member. The image support member cleaning member is in contact with an image support member on which an image is formed with liquid developer, and configured to remove liquid developer attached to the image support member. The traveling belt is formed in a loop and travels via the vicinity of the contact point between the image support member and the image support member cleaning member, and comes into contact with liquid developer stored in the cleaning unit. The belt cleaning member is in contact with the traveling belt and arranged to be downstream of the contact point between the traveling belt and liquid developer stored in the cleaning unit and upstream of the point in which the traveling belt passes the vicinity of the contact point between the image support member and the image support member cleaning member, and configured to remove liquid developer attached to the traveling belt. The image support member is comprised of a roller member or a belt member.

According to this configuration, liquid developer attached to the traveling belt is softened when the traveling belt contacts the liquid developer, and then removed by the belt cleaning member. Because of this, liquid developer attached to the traveling belt will be sufficiently removed. Therefore, the effect of cleaning the image support member cleaning member by the traveling belt can be maintained at a high level. As a result, the effect of cleaning the image support member by the image support member cleaning member can be sufficiently obtained. In addition, the traveling belt that is used as a cleaning member for cleaning the image support member cleaning member can be freely arranged in the interior of the cleaning unit. Therefore, there is no design limitation to the cleaning unit, and it is possible to inhibit the cleaning unit from increasing in size, for instance.

In addition, the traveling belt may be arranged in the vicinity of the contact point between the image support member and the image support member cleaning member such that a gap is formed between the traveling belt and the image support member. Alternatively, the traveling belt may contact the image support member in the vicinity of the contact point between the image support member and the image support member cleaning member. In this configuration, the contact between the traveling belt and the image support member will remove liquid developer attached to the image support member.

Furthermore, it is desirable that the image support member is charged at a predetermined electric potential, and a bias potential that is lower than the potential applied to the image support member or a bias potential with the reverse polarity from the potential applied to the image support member is applied to the traveling belt. According to this configuration, an electric potential difference is caused between the image support member and the traveling belt, and charged particles of liquid developer attached to the image support member, will easily attach to the traveling belt, for instance. Accordingly, efficiency of removing toner is enhanced.

Note that the traveling belt preferably travels in the same direction as the traveling direction of the image support member, in the vicinity of the contact point between the image support member and the image support member cleaning member. According to this configuration, even if the traveling belt and the image support member contact with each other, for instance, the load generated when they come into contact will be light. Thus, it is possible to prevent wear and damage to the image support member and the traveling belt.

In addition, if the traveling belt travels at the same speed as or faster than the traveling speed of the image support member, and the traveling belt and the image support member contact with each other, the traveling belt will travel while it slidingly contacts the image support member. Therefore, it is possible to enhance the removal of liquid developer attached to the image support member. Even if the traveling belt and the image support member do not contact with each other, the area of the traveling belt passing the vicinity of the contact point between the image support member and the image support member cleaning member will be increased. Therefore, it will be possible to enhance the removal of liquid developer on the image support member via the traveling belt.

In addition, it is desirable that the belt cleaning member is arranged in the vicinity of the contact point between the traveling belt and liquid developer stored in the cleaning unit. According to this configuration, liquid developer attached to the traveling belt will be softened when the traveling belt is soaked in liquid developer, and then removed immediately by the belt cleaning member. Therefore, the removal of liquid developer will be more effective.

Furthermore, a stretched portion on the traveling belt that is stretched by a support roller that supports the traveling belt is allowed to have a certain degree of deflection. Therefore, it is desirable to have the belt cleaning member contact the stretched portion of the traveling belt. With this configuration, it is possible to strongly press the belt cleaning member against the traveling belt, and thus it is possible to sufficiently remove liquid developer attached to the traveling belt. Alternatively, the belt cleaning member may be configured to contact a looped portion of the traveling belt that is looped around the support roller.

In addition, the present invention can be considered to be an image forming device that comprises a cleaning unit with the above described configuration.

According to the present invention, liquid developer attached to the traveling belt is softened when the traveling belt contacts liquid developer stored in the cleaning unit, and then removed by the belt cleaning member. Because of this, liquid developer attached to the traveling belt is sufficiently removed. Therefore, the traveling belt will be able to effectively clean the image support member cleaning member. As a result, the image support member cleaning member will be able to effectively clean the image support member. In addition, the traveling belt that is used as a cleaning member for cleaning the image support member cleaning member can be freely arranged in the interior of the cleaning unit. Therefore, there is no limitation to the design of the cleaning unit, and it is possible to inhibit the cleaning unit from increasing in size, for instance.

These and other objects, features, aspects, and advantages of the present invention will become apparent to those skilled in the art from the following detailed description, which taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the attached drawings to understand the present invention. Note that it will be apparent to those skilled in the art from this disclosure that the following descriptions of the embodiments of the present invention are provided for illustration only and not for the purpose of limiting the invention as defined by the appended claims and their equivalents.

Figure 1:
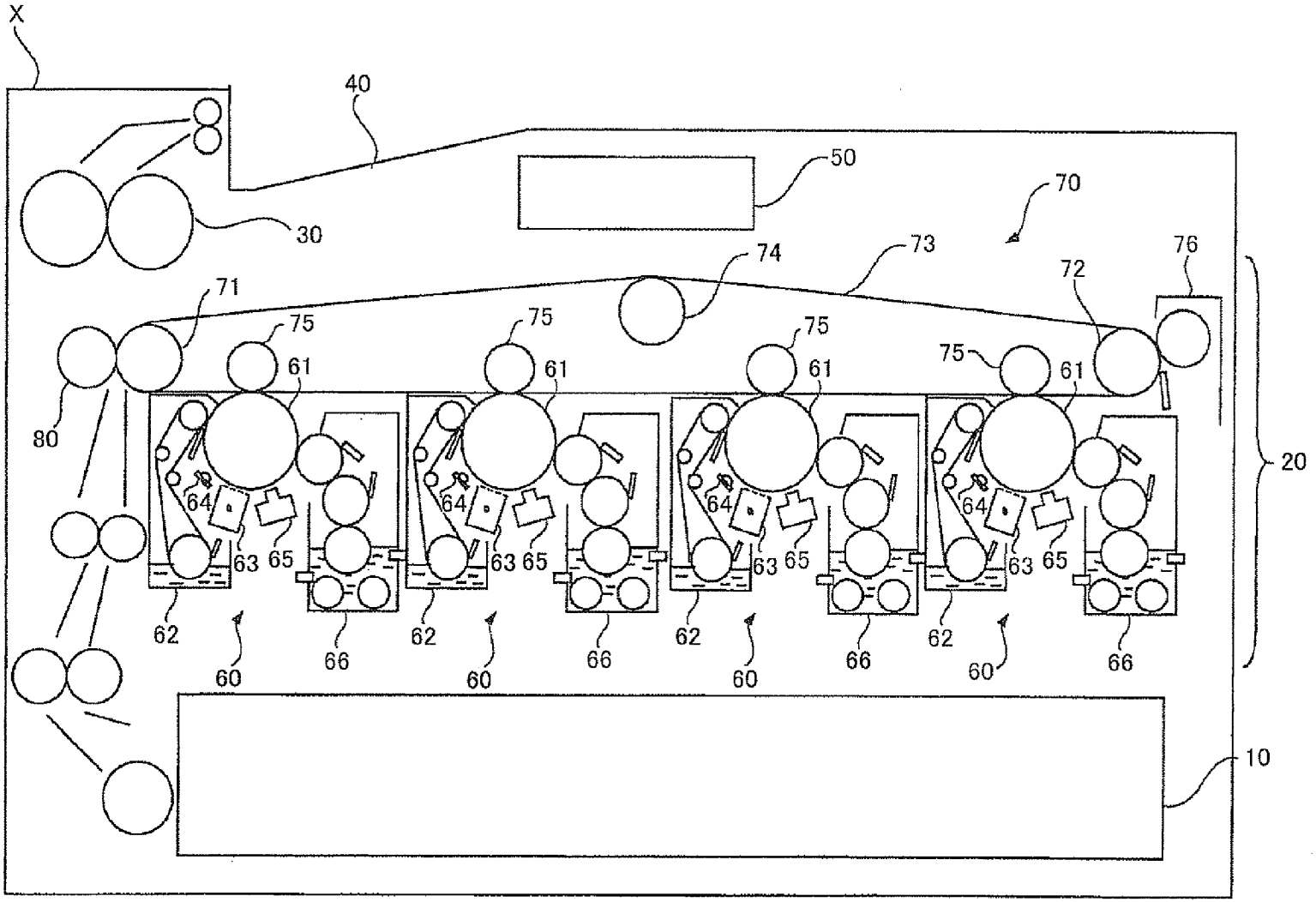
FIG. 1 shows the overall configuration of a color printer in accordance with an embodiment of the present invention.
Figure 2:
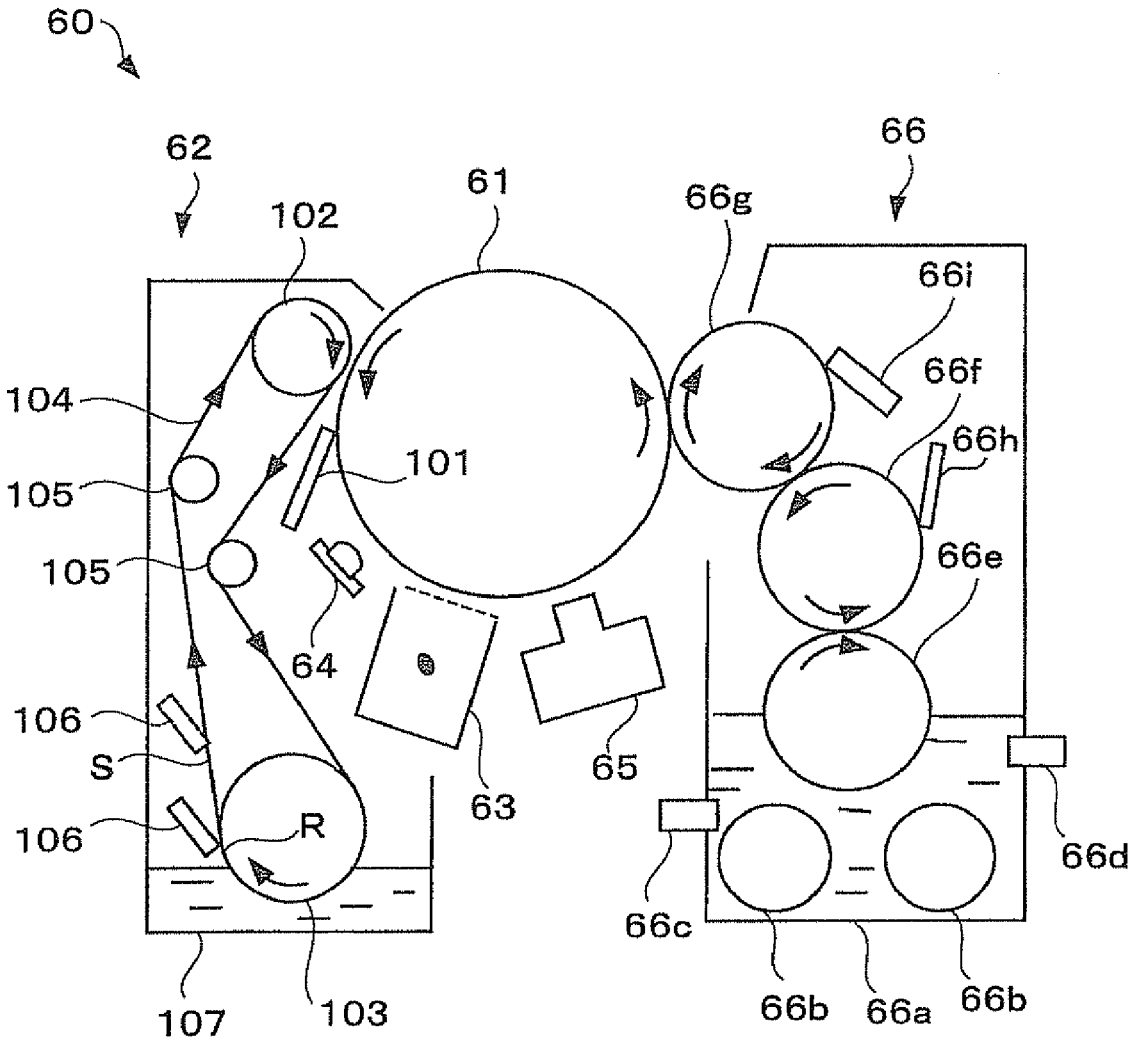
FIG. 2 shows the overall configuration of a cleaning unit and the vicinity thereof in accordance with an embodiment of the present invention.

FIG. 1 shows the overall configuration of a color printer X in accordance with one embodiment of the present invention. FIG. 2 shows the overall configuration of a cleaning unit 62 and the vicinity thereof in accordance with one embodiment of the present invention.

First, the overall configuration of the color printer X in accordance with an embodiment of the present invention will be explained with reference to FIG. 1.

The color printer X is a so-called wet image forming device that forms an image on a sheet of paper with liquid developer comprising toner that is comprised of positively charged particles and carrier solution that is comprised of non-polar insulating liquid such as silicon oil. In addition, the color printer X described below is merely an example of an image forming device in accordance with the present invention, and the present invention can also be applied to an image forming device such as a copying machine, a facsimile machine, a multifunction device image, and the like.

As shown in FIG. 1, the color printer X comprises a paper supply cassette 10, an image forming unit 20 configured to form a color image or a monochrome image on a recording medium (such as a sheet of paper) supplied from the paper supply cassette 10, a fixing unit 30 that fixes the image that was formed on the recording medium by the image forming unit 20, a discharge tray 40 to which the recording medium on which the image was fixed by the fixing unit 30 is discharged, and a control unit 50 that comprehensively controls the color printer X.

The image forming unit 20 comprises four image forming units 60 that provide four colors of toner, e.g., black (BK), magenta (M), cyan (C), and yellow (Y), an intermediate transfer unit 70 that is arranged above the four image forming units 60, and a transfer roller 80. Note that the image forming units 60 will be hereinafter explained in detail.

The intermediate transfer unit 70 comprises a driving roller 71 that is rotationally driven by a motor (not shown in the drawings), a driven roller 72 that rotates in association with the rotation of the driving roller 71, an intermediate transfer belt 73 that is looped around these two rollers, a tension roller 74 that stretches the intermediate transfer belt 73 in order to maintain an appropriate tension therein, four intermediate transfer rollers 75, each of which transfers the toner image formed on the photosensitive drum 61 (see FIG. 2) to the intermediate transfer belt 73, and a transfer belt cleaning unit 76 that removes liquid developer attached to the intermediate transfer belt 73.

The transfer roller 80 is arranged to face the driving roller 71, and transfers the toner image formed on the intermediate transfer belt 73 to a recording medium.

Next, the image forming unit 60 is hereinafter explained in detail with reference to FIG. 2.

As shown in FIG. 2, each of the four image forming units 60 comprises the photosensitive drum 61 that is comprised of amorphous silicon, a cleaning unit 62 that removes liquid developer attached to the photosensitive drum 61, an electrostatic charging unit 63 that charges the photosensitive drum 61 at a predetermined potential, a neutralization unit 64 that removes electric potential from the surface of the photosensitive drum 61, an exposing unit 65 that forms an electrostatic latent image on the photosensitive drum 61 by exposing the photosensitive drum 61 with laser light, and a developing unit 66 that develops the electrostatic latent image formed on the photosensitive drum 61 into a toner image with liquid developer. Note that the electric potential of the charged photosensitive drum 61 is set to be approximately +200 to +600 V, for instance. However, it is preferably set to be approximately +300 to +400 V based on past experience. In addition, an image support member comprised of a belt member may be used instead of using the photosensitive drum 61, which is an example of an image support member comprised of a roller member.

Each of the developing units 66 comprises a developer storage portion 66*a* in which liquid developer is stored, two agitation rollers 66*b* that agitate liquid developer in the developer storage portion 66*a*, a concentration detection sensor 66*c* that detects the concentration of toner included in liquid developer stored in the developer storage portion 66*a*, a liquid-level detection sensor 66*d* that detects the liquid level of liquid developer stored in the developer storage portion 66*a*, a drawing roller 66*e* that supplies the photosensitive drum 61 with liquid developer stored in the developer storage portion 66*a*, a supply roller 66*f*, a developing roller 66*g*, a cleaning blade 66*h* that removes liquid developer attached to the supply roller 66*f*, and a cleaning blade 66*i* that removes liquid developer attached to the developing roller 66*g*.

In the developing unit 66, liquid developer is supplied to the developer storage portion 66*a* from a developer refill unit (not shown in the drawings) according to the detection results of the concentration detection sensor 66*c* and the liquid-level detection sensor 66*d*, so as to maintain a predetermined amount and concentration of liquid developer stored in the developer storage portion 66*a*.

The color printer X in accordance with an embodiment of the present invention is characterized by the configuration of the cleaning unit 62 that removes liquid developer attached to the photosensitive drum 61. The cleaning unit 62 will be hereinafter explained in detail.

The cleaning unit 62 comprises a cleaning blade 101 (an example of an image support member cleaning member) that contacts with the photosensitive drum 61 and removes liquid developer attached thereto, a driving roller 102 that is rotatably driven by a motor (not shown in the drawings), a driven roller 103 (an example of a support roller) that rotates in association with the rotation of the driving roller 102, an cleaning belt 104 that is looped around and supported by these two rollers, a plurality of stretching rollers 105 that support the cleaning belt 104 so that it is stretched at a predetermined tension, a cleaning blade 106 (an example of a belt cleaning member) that contacts the cleaning belt 104 and removes liquid developer attached to the cleaning belt 104, and the developer storage portion 107 in which liquid developer is stored. Note that the cleaning blades 101 and 106 comprise a material such as urethane, other types of plastic, metal, or the like.

A bias potential that is lower than the potential applied to the photosensitive drum 61, or a bias potential having a polarity that is the reverse of that of the potential applied to the photosensitive drum 61, is applied to the driving roller 102 by a high-voltage power supply (not shown in the drawings). Note that the bias potential of the driving roller 102 is set to be approximately −1000 to +200 V. However, it is preferably set to be approximately −600 to −300 V based upon past experience. For example, if the photosensitive drum 61 is charged to +400 V, a bias potential of −300 V can be applied to the driving roller 102.

In addition, the cleaning belt 104 is a conductive member with a volume resistance of 1.0E+0.5 to 1.0E+11 [Ω·cm], more preferably, a volume resistance of approximately 1.0E+0.6 to 1.0E+0.9 [Ω·cm]. Therefore, the electric potential of the cleaning belt 104 is approximately the same as that of the driving roller 102 because of the bias potential of the driving roller 102.

The driving roller 102, the driven roller 103, and the plurality of stretching rollers 105, respectively, are arranged so that the cleaning belt 104 travels by way of the vicinity of the contact point between the photosensitive drum 61 and the cleaning blade 101, and the contact portion between the cleaning belt 104 and liquid developer stored in the developer storage portion 107.

Here, as shown in FIG. 2, the cleaning belt 104 is arranged to have a gap between the cleaning belt 104 and the photosensitive drum 61, and a gap between the cleaning belt 104 and the cleaning blade 101. Therefore, the cleaning belt 104 does not contact the photosensitive drum 61 and the cleaning blade 101, respectively, while the cleaning belt 104 and the photosensitive drum 61 are being driven. Therefore, wear and damage to the cleaning belt 104 and the photosensitive drum 61 can be inhibited.

On the other hand, the cleaning blade 106 is arranged in a position in which the cleaning belt 104 travels after it contacts the liquid developer stored in the developer storage portion 107, and before it travels to the vicinity of the contact point between the photosensitive drum 61 and the cleaning blade 101. More specifically, it is arranged in the vicinity of the contact point between the cleaning belt 104 and the liquid developer stored in the developer storage portion 107. Note that the cleaning blade 106 is used as a means for removing liquid developer from the cleaning belt 104 in the present embodiment, however, the present invention is not limited to this configuration, and a cleaning member such as a roller, a brush, and the like may be used instead of using the cleaning blade 106.

Here, the cleaning blade 106 contacts a looped portion R of the cleaning belt 104 that is looped around the driven roller 103. Note that a configuration in which the cleaning blade 106 is arranged in a position shown by a dashed line in FIG. 2, that is, a configuration in which the cleaning belt 104 and the cleaning blade 106 contact with each other in a stretched portion S of the cleaning belt 104 that is stretched by the driven roller 103 and the plurality of stretching rollers 105 can be considered as an alternative embodiment. In this case, the cleaning blade 106 contacts a stretched portion of the flexible cleaning belt 104 for which a certain degree of deflection is allowed. Therefore, the cleaning blade 106 can be strongly pressed against the cleaning belt 104, and accordingly it is possible to enhance the efficiency with which the liquid developer attached to the cleaning belt 104 is removed by the cleaning blade 106.

Next, an operation for removing liquid developer attached to the photosensitive drum 61 performed by the cleaning unit 62 will be explained.

Once the photosensitive drum 61 starts rotating, the cleaning belt 104 is driven in the cleaning unit 62. At this time, the cleaning belt 104 travels via the vicinity of the contact point between the photosensitive drum 61 and the cleaning blade 101 in the direction shown by arrows in FIG. 2, that is, in the same direction as the rotational direction of the photosensitive drum 61 at the contact position between the photosensitive drum 61 and the cleaning blade 101. In addition, the cleaning belt 104 travels at the same speed as or faster than the rotational speed of the photosensitive drum 61 in the vicinity of the contact point between the photosensitive drum 61 and the cleaning blade 106. For example, the cleaning belt 104 travels at a speed of 1.0 to 1.3 times as fast as the rotational speed of the photosensitive drum 61.

As described above, in the cleaning unit 62, when the cleaning belt 104 travels in the vicinity of the contact point between the photosensitive drum 61 and the cleaning blade 101, it contacts liquid developer accumulated on the cleaning blade 101. Thus, liquid developer accumulated on the cleaning blade 101 will be removed. At this time, as described above, a bias potential that is lower than the potential applied to the photosensitive drum 61, or a bias potential with the reverse polarity from the potential applied to the photosensitive drum 61, is applied to the cleaning belt 104. Therefore, charged toner particles included in the liquid developer will easily move to the cleaning belt 104, and thus the liquid developer will be removed with good efficiency.

In addition, if the cleaning belt 104 travels faster than the rotational speed of the photosensitive drum 61 in the vicinity of the contact point between the photosensitive drum 61 and the cleaning blade 101, the area of the cleaning belt 104 passing the vicinity of the contact between the two will be increased. Therefore, the effect of removing liquid developer by the cleaning belt 104 is enhanced.

Note that liquid developer removed by the cleaning belt 104 passes the gap formed between the cleaning belt 104 and the cleaning blade 101, and then it is transported by the cleaning belt 104.

Next, the cleaning belt 104 is soaked in liquid developer stored in the developer storage portion 107.

Thus, in the cleaning unit 62, the cleaning belt 104 travels via the vicinity of the contact point between the photosensitive drum 61 and the cleaning blade 101, and the contact portion between the cleaning belt 104 and the liquid developer stored in the developer storage portion 107. Thus, liquid developer attached to the cleaning belt 104 will be softened when the cleaning belt 104 contacts liquid developer stored in the developer storage portion 107.

Then, after the cleaning belt 104 contacts liquid developer stored in the developer storage portion 107, it will contact the cleaning blade 106 before it travels to the vicinity of the contact point between the photosensitive drum 61 and the cleaning blade 101 again. When the cleaning belt 104 comes into contact with the cleaning blade 106, the cleaning blade 106 will remove liquid developer attached to the cleaning belt 104. Here, liquid developer attached to the cleaning belt 104 was softened when the cleaning belt 104 was in contact with liquid developer stored in the developer storage portion 107. Therefore, the removal of liquid developer is effectively performed. In particular, the cleaning blade 106 is arranged in the vicinity of the contact portion between the cleaning belt 104 and liquid developer stored in the developer storage portion 107, and liquid developer attached to the cleaning belt 104 is softened and then immediately removed. Therefore, removal thereof is more effectively performed.

Liquid developer removed from the cleaning belt 104 by the cleaning blade 106 drops and is stored in the developer storage portion 107. Note that if the liquid-level detection sensor 108 detects that the amount of liquid developer stored in the developer storage portion 107 is more than a predetermined amount, the amount of the liquid developer that exceeds the predetermined amount will be discarded or transported to a developer storage portion 66*a* in the developing unit 66 via a transportation path (not shown in the drawings) and reused.

In the present embodiment, the cleaning belt 104 is used as a cleaning member for cleaning the cleaning blade 101. However, it is possible to clean the cleaning blade 101 with a roller member instead of using the cleaning belt 104. Note that in this configuration, some design limitations are required in order to achieve a configuration in which the roller member is cleaned after it is once soaked in liquid developer. For example, the roller member must be formed in a large size, and the developer storage portion 107 in which liquid developer is stored must be formed in a large size.

However, in the cleaning unit 62 described in the present embodiment, it is possible to freely arrange the cleaning belt 104 in the interior of the cleaning unit 62 by arbitrarily changing positions and the number of the driving roller 102, the driven roller 103, and/or the stretching roller 105, all of which support the cleaning belt 104. Thus, there is no limitation to the design of the cleaning unit 62. Therefore, it is possible to prevent the size of the cleaning unit 62 from increasing, and it is possible to realize a reduction in the size thereof.

ALTERNATIVE EMBODIMENT

An alternative embodiment of the present invention will now be described by focusing on the differences with the above described embodiment of the present invention. In view of the similarity between the above described embodiment and the alternative embodiment, the parts of the alternative embodiment that are identical to the parts of the above described embodiment will be given the same numerals as the parts of the above described embodiment. Moreover, the descriptions of the parts of the alternative embodiment that are identical to the parts of the above described embodiment may be omitted for the sake of brevity.

A cleaning unit 62A, which is an alternative to the cleaning unit 62 in the above described embodiment, will be hereinafter explained as an alternative embodiment of the present invention. Here, FIG. 3 is a diagram for explaining the cleaning unit 62A.

Figure 3:
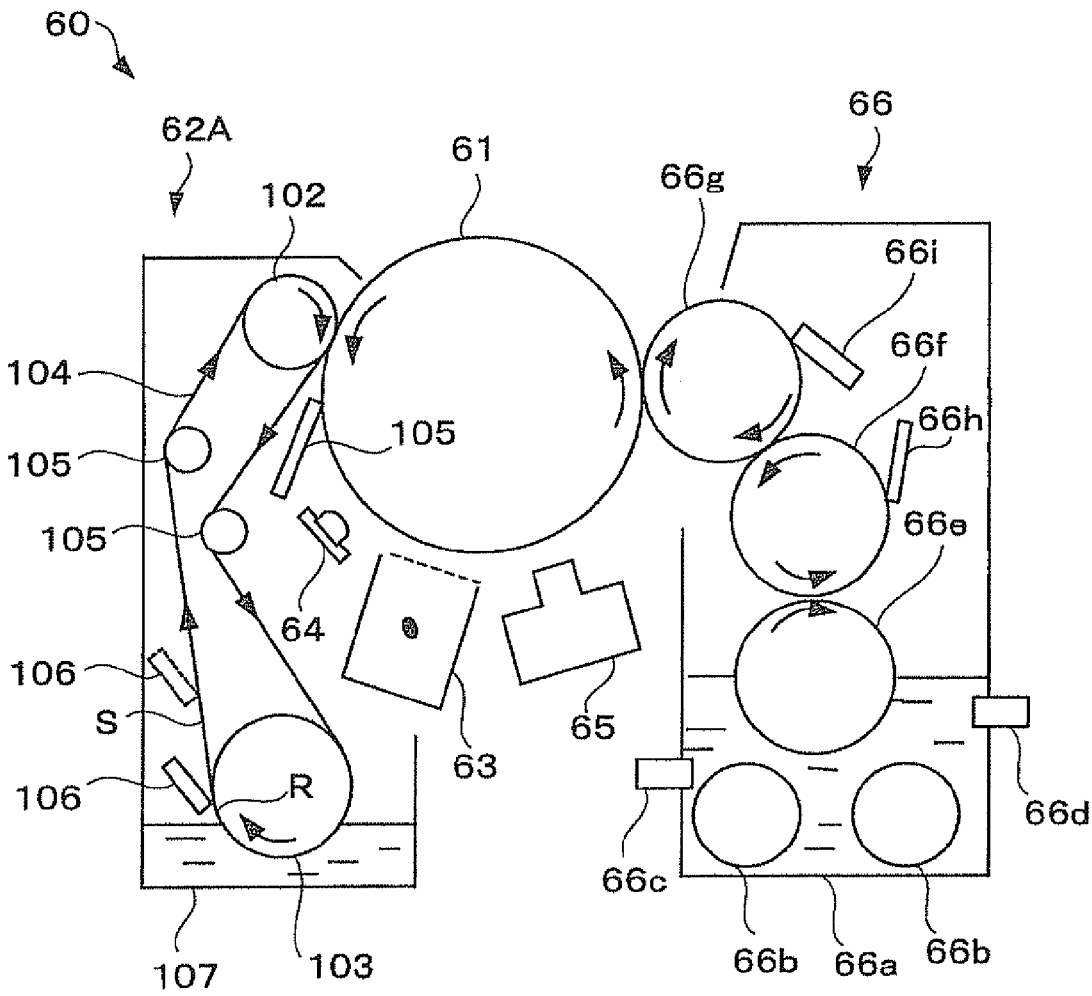
FIG. 3 shows a cleaning unit in accordance with an alternative embodiment of the present invention.

As shown in FIG. 3, the configuration of the cleaning unit 62A is different from that of the cleaning unit 62 in the above described embodiment in that in the cleaning unit 62A, the cleaning belt 104 contacts the photosensitive drum 61 in the vicinity of the contact point between the photosensitive drum 61 and a cleaning blade 105 in the path that the cleaning belt 104 travels.

In the cleaning unit 62A with this configuration, the cleaning belt 104 travels so as to be in contact with the photosensitive drum 61 when it is driven. Therefore, liquid developer attached to the photosensitive drum 61 is removed by the contact between the cleaning belt 104 and the photosensitive drum 61. In particular, if a bias potential that is lower than the potential applied to the photosensitive drum 61, or a bias potential with the reverse polarity from the potential applied to the photosensitive drum 61, is applied to the cleaning belt 104, the efficiency with which toner attached to the photosensitive drum 61 is removed will be enhanced. In other words, in the cleaning unit 62A, the cleaning belt 104 can be considered as a cleaning member for cleaning the photosensitive drum 61. Here, the cleaning belt 104 in this alternative embodiment also cleans the cleaning blade 105, as with the above described embodiment.

Note that the rotational direction of the photosensitive drum 61 at the contact point between the photosensitive drum 61 and the cleaning blade 105 is the same as the traveling direction of the cleaning belt 104 at the same point. Therefore, even if the cleaning belt 104 and the photosensitive drum 61 contact with each other as described above, a heavy load will not be generated in the cleaning belt 104 and the photosensitive drum 61. Thus, it is possible to prevent wear and damage to the cleaning belt 104 and the photosensitive drum 61.

GENERAL INTERPRETATION

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A cleaning unit comprising:

an image support member cleaning member contacting an image support member on which an image is formed with liquid developer, and being configured to remove liquid developer attached to the image support member;

an endless traveling belt traveling via the vicinity of the contact point between the image support member and the image support member cleaning member, and contacting liquid developer stored in the cleaning unit; and a belt cleaning member contacting the traveling belt, being arranged on a portion of the endless traveling belt being between a point downstream of the contact point between the traveling belt and liquid developer stored in the cleaning unit and a point upstream of the point at which the traveling belt passes the contact point between the image support member and the image support member cleaning member in the traveling direction of the traveling belt, and configured to remove liquid developer attached to the traveling belt, the endless traveling belt contacting the image support member at a portion closer to the image support cleaning member than to a portion at which the endless traveling belt contacts the belt cleaning member.

2. The cleaning unit according to claim 1, wherein the traveling belt travels in the same direction as the traveling direction of the image support member in the vicinity of the contact point between the image support member and the image support member cleaning member.

3. The cleaning unit according to claim 2, wherein the traveling belt travels at the same speed as or faster than the traveling speed of the image support member.

4. The cleaning unit according to claim 1, wherein the belt cleaning member is arranged in the vicinity of the contact point between the traveling belt and liquid developer stored in the cleaning unit.

5. The cleaning unit according to claim 1, wherein the belt cleaning member comes into contact with a stretched portion on the traveling belt that is stretched by a support roller that supports the traveling belt, or a looped portion of the traveling belt that loops around the support roller.

6. The cleaning unit according to claim 1, further comprising a driving roller, a driven roller arranged opposite the driving roller, the endless traveling belt is looped around the driving roller and the driven roller, the endless traveling belt has a first side where the endless traveling belt moves from the driven roller to the driving roller and a second side where the endless traveling belt moves from the driving roller to the driven roller, the first side is opposite the side on which the image support member is arranged, and a developer storage portion in which liquid developer is stored, at least a portion of the driven is arranged in the developer storage portion such that the endless belt contacts liquid developer.

7. The cleaning unit according to claim 6, wherein the belt cleaning member is arranged to contact the endless traveling belt on the first side.

8. An image forming device comprising:

an image support member on which an image is formed with liquid developer; and a cleaning unit, having an image support member cleaning member contacting the image support member and being configured to remove liquid developer attached to the image support member, an endless traveling belt traveling via the vicinity of the contact point between the image support member and the image support member cleaning member, and contacting liquid developer stored in the cleaning unit, and a belt cleaning member contacting the traveling belt, being arranged on a portion of the endless traveling belt being between a point downstream of the contact point between the traveling belt and liquid developer stored in the cleaning unit and a point upstream of the point in which the traveling belt passes the contact point between the image support member and the image support member cleaning member in the traveling direction of the traveling belt, and configured to remove liquid developer attached to the traveling belt, the endless traveling belt contacting the image support member at a portion closer to the image support cleaning member than to a portion at which the endless traveling belt contacts the belt cleaning member.

9. The image forming device according to claim 8, wherein the cleaning unit further includes a driving roller, a driven roller arranged opposite the driving roller, the endless traveling belt is looped around the driving roller and the driven roller, the endless traveling belt has a first side where the endless traveling belt moves from the driven roller to the driving roller and a second side where the endless traveling belt moves from the driving roller to the driven roller, the first side is opposite the side on which the image support member is arranged, and a developer storage portion in which liquid developer is stored, at least a portion of the driven is arranged in the developer storage portion such that the endless belt contacts liquid developer.

* * * * *